US010575652B2

(12) United States Patent
Russell

(10) Patent No.: US 10,575,652 B2
(45) Date of Patent: Mar. 3, 2020

(54) ROCKING BED WITH BRAKING MECHANISM

(71) Applicant: Mark Russell, Canton, GA (US)

(72) Inventor: Mark Russell, Canton, GA (US)

( * ) Notice: Subject to any disclaimer, the term of this patent is extended or adjusted under 35 U.S.C. 154(b) by 403 days.

(21) Appl. No.: 15/456,060

(22) Filed: Mar. 10, 2017

(65) Prior Publication Data

US 2017/0258241 A1 Sep. 14, 2017

Related U.S. Application Data

(60) Provisional application No. 62/307,482, filed on Mar. 12, 2016, provisional application No. 62/368,830, filed on Jul. 29, 2016.

(51) Int. Cl.
*A47C 21/00* (2006.01)

(52) U.S. Cl.
CPC ..... *A47C 21/006* (2013.01)

(58) Field of Classification Search
CPC ..... A47C 3/0251; A47C 21/006; A47D 9/02; A47D 13/10; A63G 9/22
See application file for complete search history.

(56) References Cited

U.S. PATENT DOCUMENTS 2,570,676 A 10/1951 Henderson
2,649,595 A * 8/1953 Lewin ..... A47C 20/048 5/616
2,808,828 A 10/1957 Rubin
3,031,687 A 5/1962 Stevens
3,056,144 A 10/1962 McKinley
3,378,859 A 4/1968 Parker
4,071,916 A 2/1978 Nelson
4,087,872 A 5/1978 Smirle
4,152,795 A 5/1979 Rodosta
4,258,446 A * 3/1981 McAllister ..... A47D 9/02 5/105
5,228,155 A 7/1993 Shultz
5,572,752 A 11/1996 McGee
5,625,913 A * 5/1997 Singleton ..... A47C 21/006 5/430
7,281,284 B2 10/2007 Sims
7,478,446 B2 1/2009 Sims
7,591,035 B2 9/2009 Guo
7,653,952 B2 2/2010 Guo
8,707,477 B1 4/2014 Flemister
8,789,220 B2 7/2014 Flemister
8,856,982 B1 * 10/2014 Kalivas ..... A61G 7/002 5/103

(Continued)

FOREIGN PATENT DOCUMENTS

FR 2099420 A1 * 3/1972 ..... A47C 21/006
JP 2003052488 A * 2/2003 ..... A47C 21/006

OTHER PUBLICATIONS

Sleep in Motion, Youtube Video, https://www.youtube.com/watch?v=Gp0OIbWhr4c Mar. 4, 2014.

*Primary Examiner* — Nicholas F Polito
(74) *Attorney, Agent, or Firm* — Fish & Richardson P.C.

(57) ABSTRACT

A rocking bed foundation includes an upper frame supported on rollers over a lower frame such that the upper frame can support a mattress for transverse reciprocal movement under the influence of a driver mounted within the foundation and further such that the upper frame can be locked to prevent movement when the driver is disengaged.

17 Claims, 7 Drawing Sheets

(56) References Cited

U.S. PATENT DOCUMENTS

| | | | | |
|---|---|---|---|---|
| 8,863,325 | B1 | 10/2014 | Fiterson | |
| 2007/0120404 | A1* | 5/2007 | Bellows | A47D 9/02 297/256.16 |
| 2007/0143923 | A1 | 6/2007 | Guo | |
| 2007/0143924 | A1 | 6/2007 | Guo | |
| 2012/0073059 | A1* | 3/2012 | Oh | A47C 21/022 5/692 |

* cited by examiner

ROCKING BED WITH BRAKING MECHANISM

This application claims priority from U.S. Provisional patent applications No. 62/307,482, filed Mar. 12, 2016 and No. 62/368,830, filed Jul. 29, 2016, both of which are expressly incorporated herein by reference.

FIELD OF INVENTION

This invention replaces a user's foundation or box spring and enables the user to be gently rocked to sleep with provision for locking the mechanism in place when rocking is not desired.

BACKGROUND

People enjoy being rocked to sleep. Every baby in the world has at one time or another been rocked to sleep. As people get older and bigger, and being rocked to sleep is not feasible because it requires bigger machinery to rock bigger bodies. In the prior art, others have implemented beds that rock back and forth actuated with various mechanisms. However none of them have implemented pinch point protection with soft fabric covers, nor have they implemented braking systems. Further, many of the other inventions included a specialized bed frame. Other attempts to provide a suitable rocking bed have hard moving parts on the outside which allows fingers to inadvertently enter into possible pinch points. Prior devices also allow continual movement as they do not have braking systems to prevent a moving bed from moving when movement is unwanted. The known devices in many instances force the user to replace their current furniture or bed frame even though in many cases a user will want to retain their current style furniture and will not want to replace their bed frame Just to achieve the functionality of rocking back and forth.

SUMMARY OF THE INVENTION

My Invention solves the following problems:

1. The need to replace a current bed frame.—Just because someone wants their bed to rock, does not mean that they want to replace their furniture to achieve this functionality. My rocking bed invention is designed to replace the box spring as a mattress foundation rather than a bed frame. This embodiment replaces the user's current box spring and it is placed on a regular bed frame to solve the problem of being able to rock an adult back and forth to sleep without having to replace their furniture 2. Motion prevention when unit is turned off via a motion prevention system. Previous rocking beds design that are motorized or not, such as those that freely swing on pendulum mechanism, or those on different types of rollers lack mechanisms to prevent the moving bed from moving or in embodiments where there is a motor, when the motor is turned off. This lack of motion prevention creates a problem, in that a bed that is designed to move also needs to be designed to not move. If it does not have a braking mechanism, when one person moves in bed, the entire bed will move waking up the other person. In my invention, through the implementation of a braking system which could take the form of one or multiple of the following: an encoder maintaining position with servo motor or physical block such as a pin and in case of a motor, including a deactivation switch, the rocking motion of the bed would automatically be prevented when the motor was not turned on. Other rocking beds that create movement do not have mechanisms to prevent unwanted movement in the system so that when one partner rolls over it disturbs the others in the bed. My invention prevents unwanted movement.

3. Pinch point solution via soft flexible cover—Other rocking bed embodiments have been created in such a way that the moving parts are on the outside of the unit. They are also hard thus you have hard parts moving in an area where fingers and human body parts can get in trapped, pinched, and hurt. In my invention, because it is not a bed frame but rather a replacement for a box spring, the moving mechanisms are wrapped in the same way that typical box springs are wrapped, with a fabric protective cover. This fabric protective cover is designed to stretch as the box spring actuates. This fabric acts as a protective layer to prevent access to pinch points which are inset into the unit.

4. Multi-layer fabric protective cover creating a clean look, while also preventing access to moving parts. One rocking bed embodiment will have a protective cover of which the part of the cover that covers the "side" of the unit is made of multiple layers of fabric both stretchable and non-stretchable. These side fabric layers are arranged in such a way so that the outside layer of fabric is more flexible to draw tight and present a clean "normal box spring" appearance while the inner layer of fabric is made from non-elastic material, loosely "billowed". This billowing or pleating of the fabric will provide the extra fabric needed to allow the bed to freely actuate, but because it is made from non-stretchable material, will prevents body parts from accessing the pinch points within the unit, as the will not be enough fabric to allow a foreign object to reach the moving parts.

BRIEF DESCRIPTION OF THE DRAWINGS

Referring to the drawings which are appended hereto and which form a portion of this disclosure, it may be seen that.

DETAILED DESCRIPTION

Figure 1:
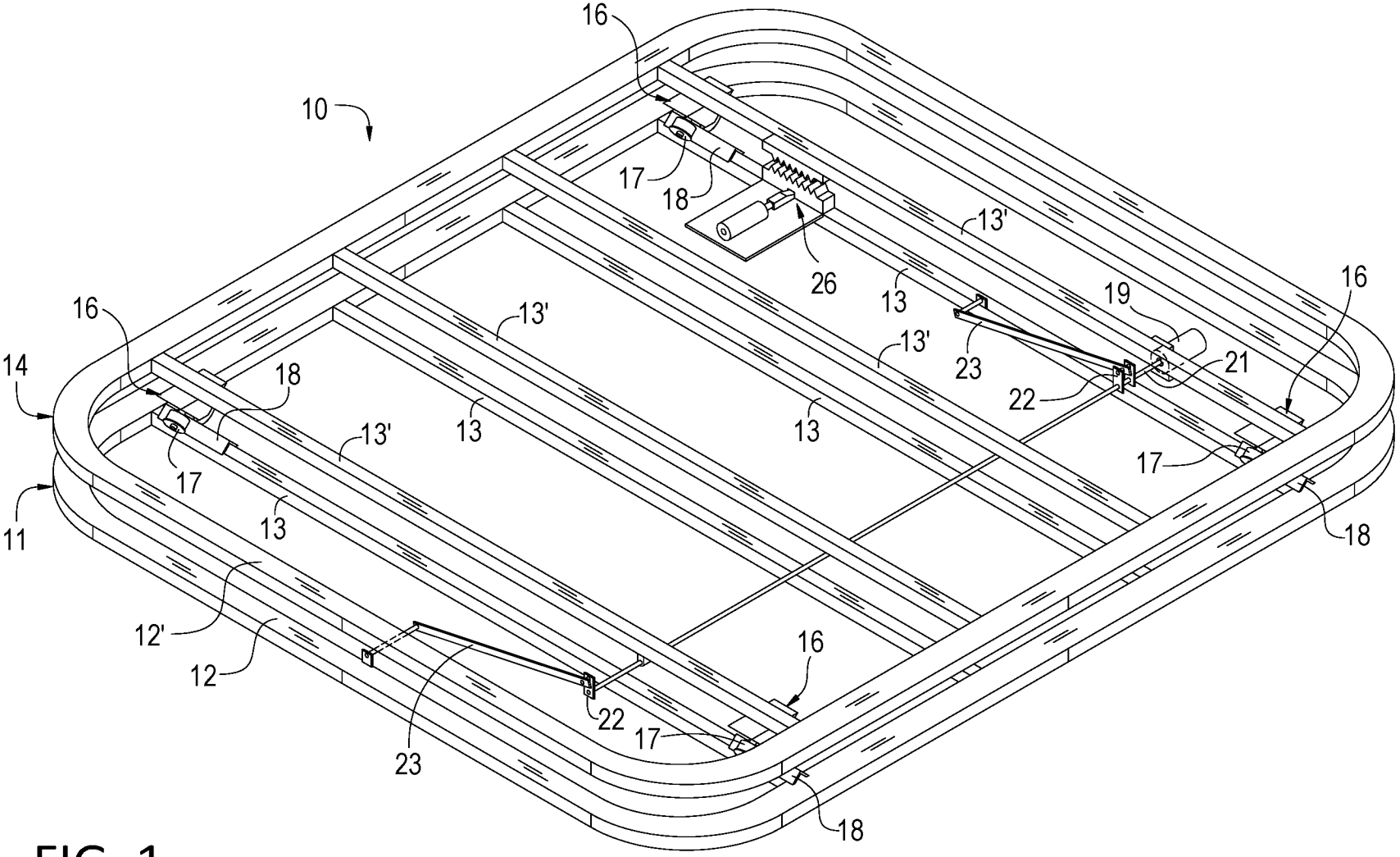
FIG. 1 is a perspective of one embodiment of my rocking mattress support.
Figure 2:
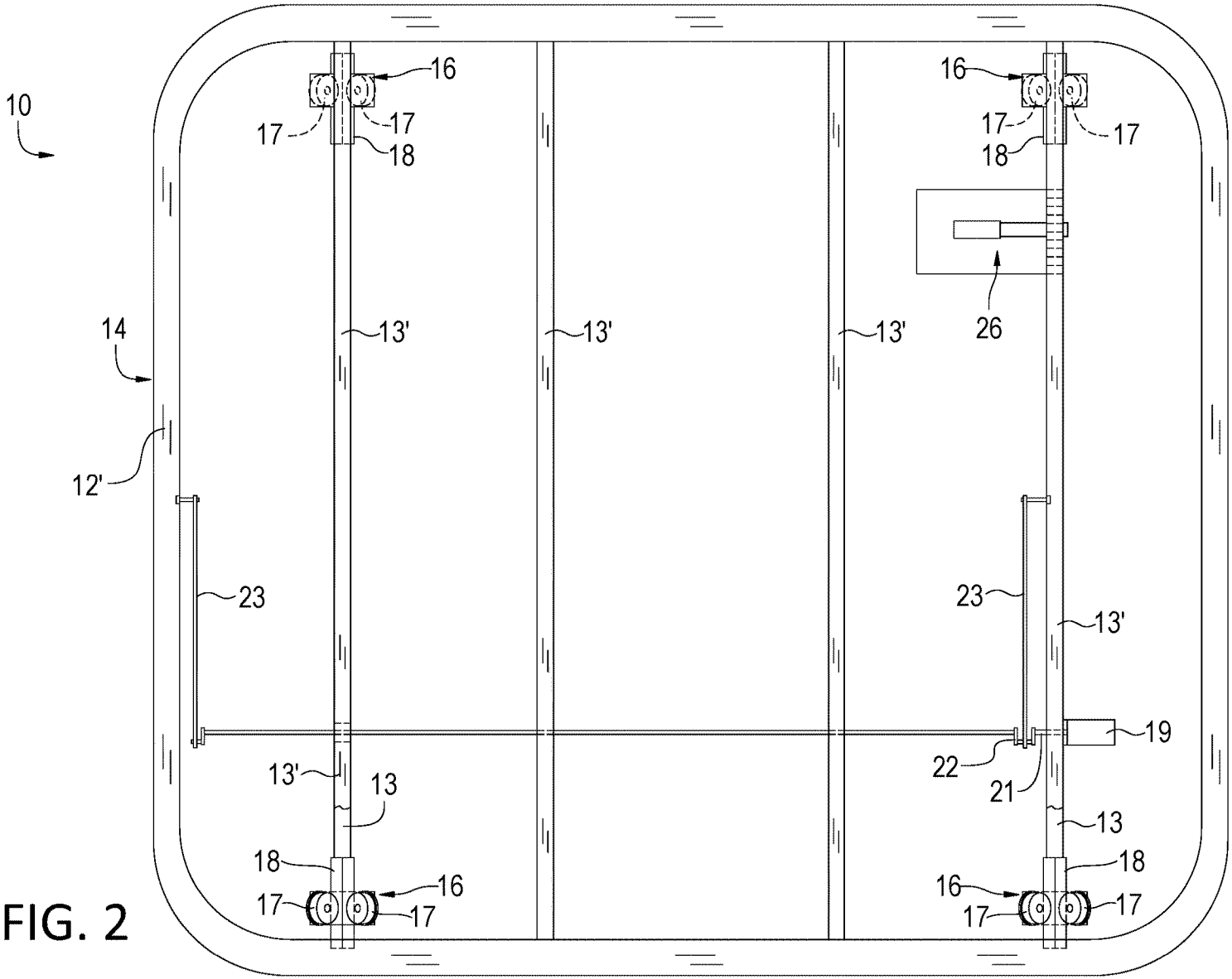
FIG. 2 is a plan view of the embodiment shown in FIG. 1.
Figure 3:
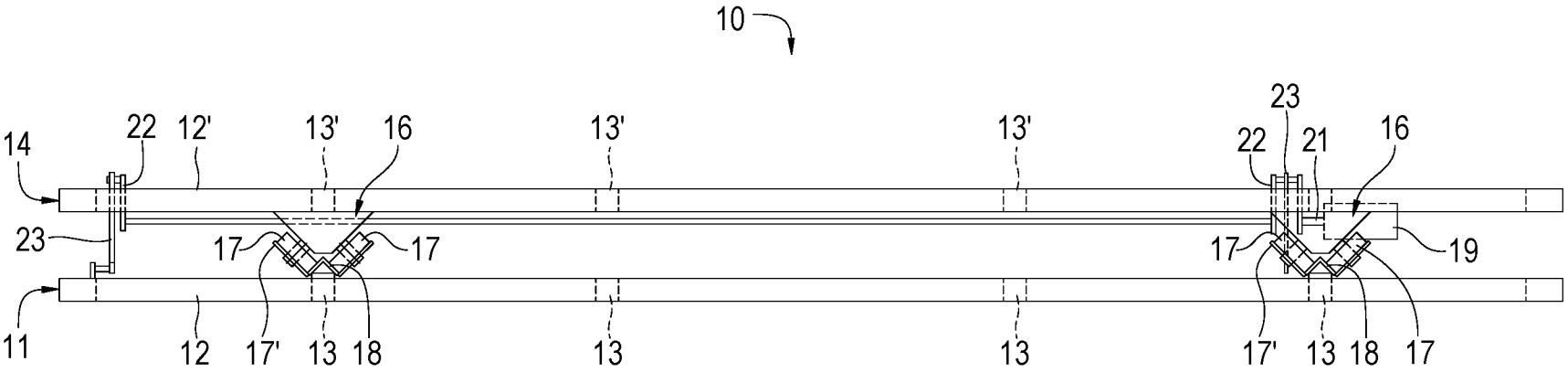
FIG. 3 is a side elevation of the embodiment shown in FIG. 2.
Figure 4:
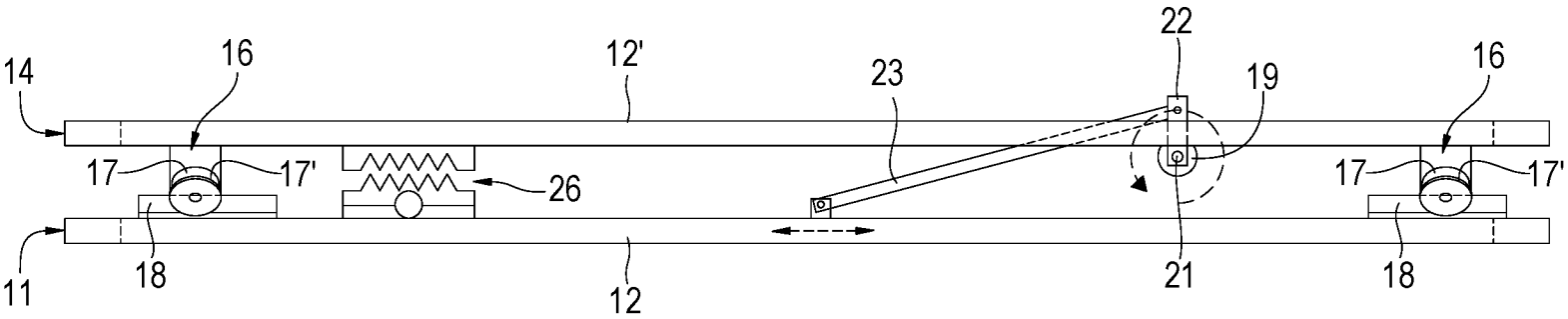
FIG. 4 is an end view of the embodiment shown in FIG. 1.

One or more of the above objects can be achieved, at least in part, by providing the rocking bed frame 10 as shown in FIG. 1. Rocking bed frame 10 includes a lower frame 11 which engages the standard rails of a conventional bed frame, not shown. Lower frame 11 includes a closed outer frame member 12 and a plurality of transverse frame members 13. Outer frame 12 and transverse frames 13 may be made from steel or aluminum and may be connected by welding or may be connected by suitable connections which would include elastomeric cushioning and sound damping components. Likewise outer frame 12 may include elastomeric cushions about its length and width to engage the conventional bed frame to prevent slippage and provide sound attenuation. Also provided is an upper frame 14 which is constructed in the same manner as lower frame 11 and includes an upper closed outer frame 12' and upper transverse frame members 13'. It should be noted that outer frames 12 and 12' need not be closed, however, it is believed that superior rigidity and stability can be achieved if the outer frame is closed. It should further be understood that outer frame 12 may be "closed" by providing a transverse member 13 at each end of opposing outer frame members.

As may be seen in the figures, at least two of the upper transverse frame members 13' are provided with carriages 16 spaced apart along the length of the at least two upper frame members 13'. Each carriage 16 carries a pair of rollers 17, which may be polyurethane, delrin or some other suitable material, mounted to engage the upper surfaces of an inverted V shaped track 18 which mounted on complementary aligned transverse frame members 13. Thus, it will be understood that lower frame 11 supports upper frame 14 by supporting the rollers 17 on tracks 18. It is further noteworthy to mention that each track 18 need only extend sufficiently to allow for the desired reciprocal motion of the upper frame 14 relative to the lower frame 11. It should also be understood that the carriage and rollers may be inverted and mounted to the lower frame 11 with the track 18 likewise inverted and mounted to the upper frame 14. Further, the rollers 17 are provided with a peripheral lateral flange 17' that subtends below the longitudinal edge of the V shaped track 18 and thus insures that the paired rollers 17 will remain vertically engaged with the track 18.

It will be seen in the Figures that a motor 19 is mounted to either the lower frame 11 or upper frame 14. In the embodiments shown, the motor 19 is a rotary electric motor which has an output drive shaft 21 which carries at least one transverse drive arm 22 to provide eccentric connection to one or more drive rods 23. The opposite end of the drive rod 23 is connected to the complementary frame such that as motor 19 rotates, the rotational movement is transferred to reciprocal linear movement of upper frame 14 which carries a mattress. Obviously, the motor 19 is a low speed motor and it is contemplated that the speed can varied using a simple control 25 mounted on a controller console 24 to be placed near the bed. It also to be understood that the console may include a timer 26 to turn the motor 19 off after a predetermine time. In more sophisticated embodiments, the console may include a chip which allows the user to program the speed and duration of the rocking and any other profile features that may be desired. It should be understood that a rotary motor is only one type of drive that may be used and a linear actuator connected between frames 11 and 14, a belt or chain drive or worm gear similarly connected may also be used.

Figure 5:
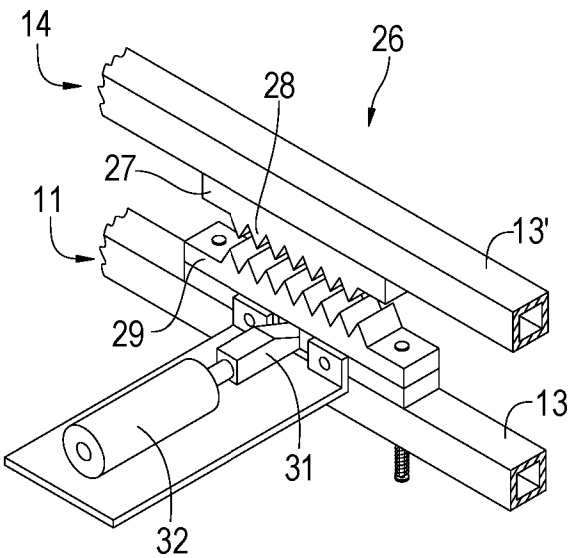
FIG. 5 is a detail view of a first embodiment of a braking mechanism using serrated engagement blocks.
Figure 7:
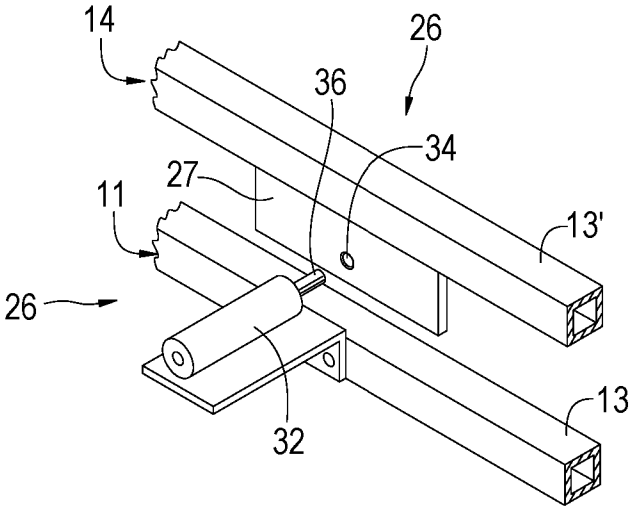
FIG. 7 is a detail view of a third embodiment of a braking mechanism using a pin brake.
Figure 8:
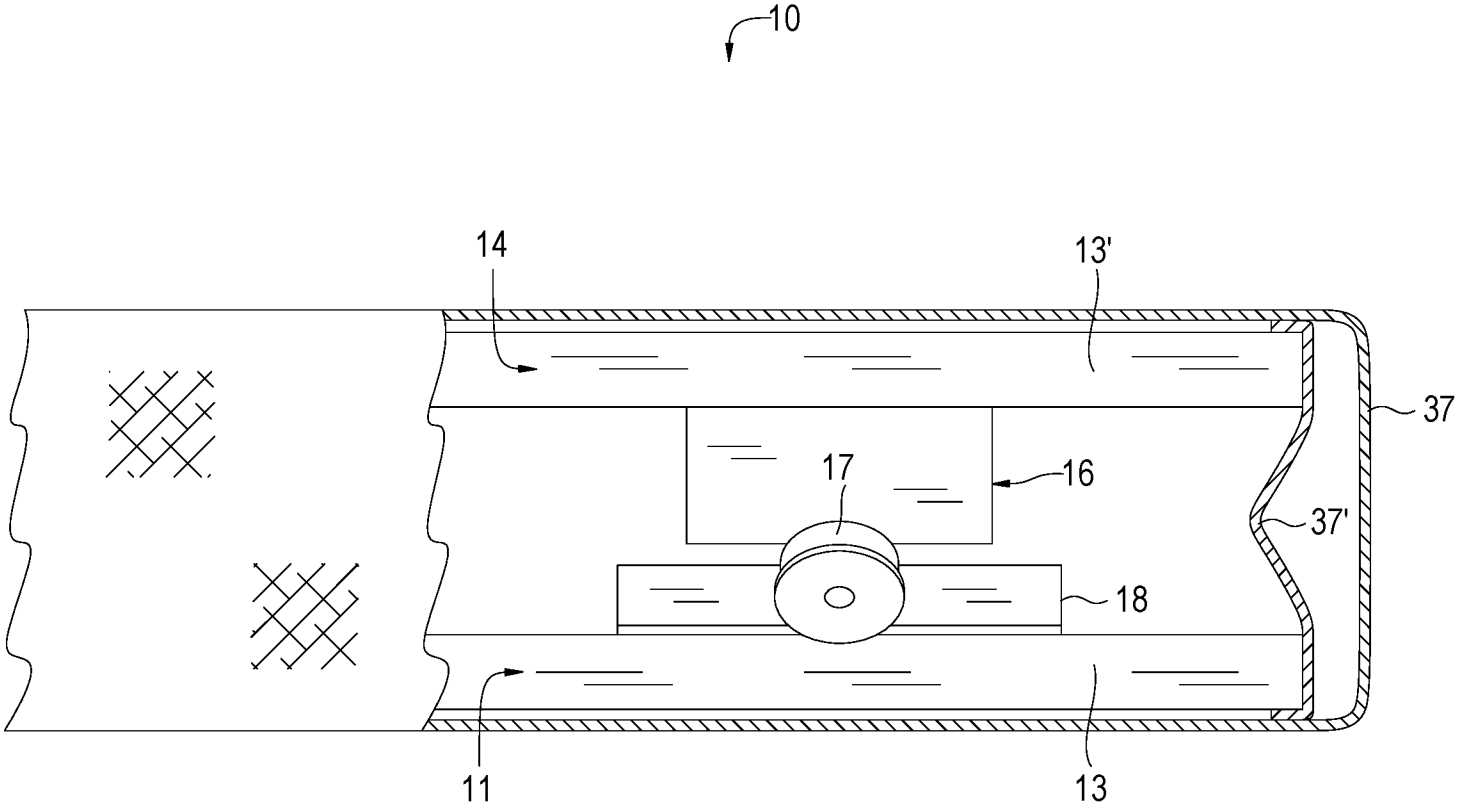
FIG. 8 is a detail view of a protective cover.
Figure 9:
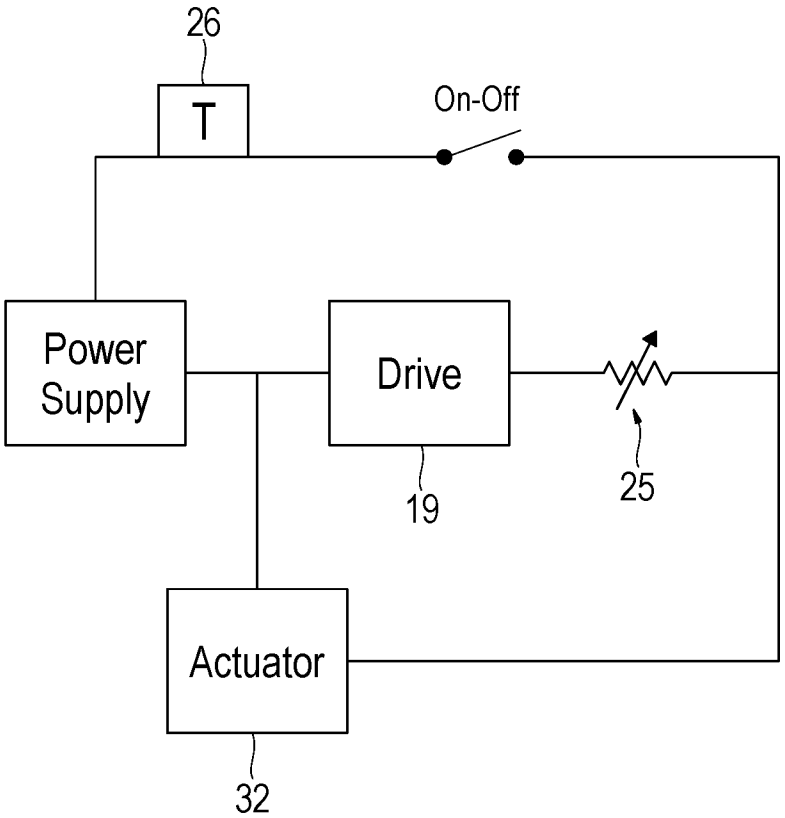
FIG. 9 is a schematic of the control components.

To alleviate problems associated with an unstable mattress when the motor 19 is not in operation, I have provided a brake 26 for the upper frame 14. Referring to FIG. 5, note that at least one of the upper transverse frame members 13' carries a lock block 27 which has a length along the frame member longer than the distance that the frame moves during its reciprocation. The bottom of the lock block 27 is serrated such that a plurality of downwardly opening notches between teeth 28 are formed. Mounted below lock block 27 is movable lock block 29 which can move vertically but is constrained to remain in place horizontally. Movable lock block has complementary teeth and notches. Movable lock block 29 is spring loaded to a downward disengaged position, however, a powered camming wedge 31 is biased to move beneath the movable lock block and urge it upwardly into is position where its notches and teeth engage with those of lock block 27, thereby locking the upper frame 14 from lateral movement. Camming wedge 31 is retracted by a linear actuator 32 whenever the motor 19 is actuated such that the motor 19 does not work against the brake 26.

Figure 6:
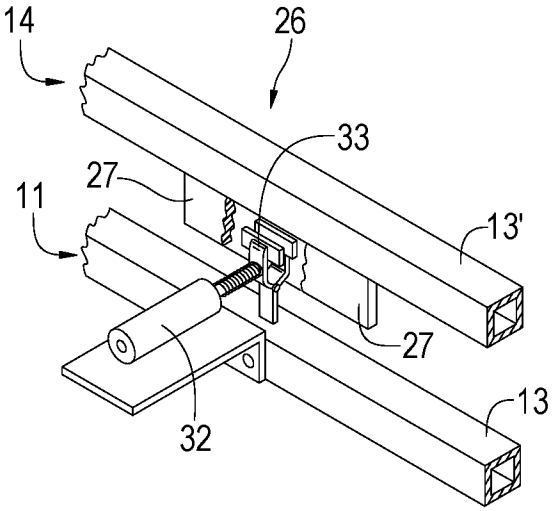
FIG. 6 is a detail view of a second embodiment of a braking mechanism using a caliper brake.

In a second embodiment shown in FIG. 6 the serrations on lock block 27 are eliminated and the movable lock block is replaced by a caliper 33 mounted to selectively grasp the lock block 27. Caliper 33 is normally biased to closed position and is forced to an open position by an actuator 32 whenever motor 19 is actuated. Caliper braking provides braking at any point along the line of travel of the upper frame as opposed to the notched braking of the serrated teeth.

Figure 10:
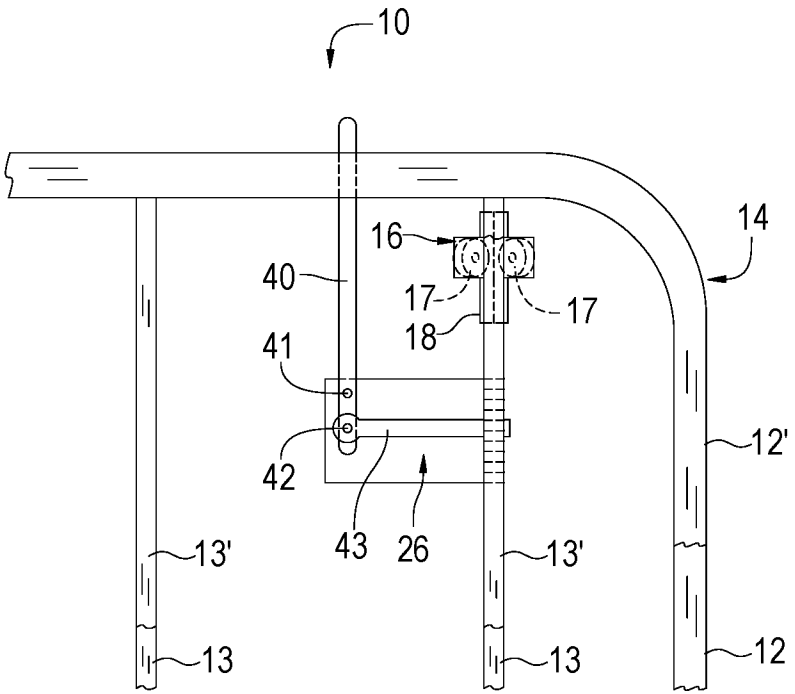
FIG. 10 is a detail view of a lever for mechanically actuating a braking mechanism.

In a third form of mechanical braking, lock block 27 has an aperture 34 formed transversely of transverse frame member 13' and caliper 33 is replaced by a pin 36 moveable horizontally between a position retracted from said aperture and a position engaged within said aperture. Again the pin 36 is appropriately moved from and into engagement by linear actuator 27 which for example may be connected in parallel with motor 19, however, in this embodiment upper frame 14 has a single locking position. With each of the forgoing brake devices it should be understood that although they may be electrically operated in conjunction with the driver, they may also be mechanically operated by a lever positioned to extend from the edge of the frame as shown in FIG. 10. Lever 40 is mounted to a pivot pin 41 and connected to arm 43 at link pin 42. Thus as the lever 40 moves about pin 41 arm 43 serves as the actuator for the brake 26.

Irrespective of which brake 26 is used, I provide a skirt 37 of material extending from upper frame 14 to lower frame 11 such that no objects, including fingers, toes, limbs, toys, etc. may be inserted between the upper and lower frames to come into contact with any moving part or to become otherwise captured, pinched or enmeshed in the mechanism. The material of skirt 37 may be an elastic or stretchable layer of material or a multiply material with an outer stretchable layer and an inner layer 37' which has sufficient material to allow the movement of the frame without stretching or being itself caught in the mechanism. This layer may be billowed or pleated as needed to provide the necessary movement of the upper frame.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

What I claim is:

1. An apparatus for supporting a mattress of a bed for gentle side to side rocking motion comprising:

a. a lower frame including at least two transverse frame members;

b. an upper frame including at least two transverse upper frame members parallel said at least to transverse frame members;

c. a plurality of roller carriages supporting at least two transverse upper frame members and supported for movement of said upper frame on said at least two transverse frame members;

d. a driver connected between said lower frame and said upper frame to reciprocally move said upper frame transversely of said lower frame; and, e. a brake connected to arrest movement of said upper frame relative to said lower frame when said driver is not actuated;

further comprising a protective skirt enclosing said upper and lower frames about a periphery thereof to prevent ingress of objects between said upper and lower frames, wherein said protective skirt is a multilayer construction including an outer stretchable layer and an inner non-stretchable layer having sufficient material to allow movement of said upper frame relative to said lower frame.

2. The apparatus as defined in claim 1 wherein said protective skirt is stretchable to allow movement of said upper frame relative to said lower frame.

3. The apparatus as defined in claim 1 wherein said protective skirt is loosely connected to said upper and lower frame to allow movement of said upper frame relative to said lower frame.

4. The apparatus as defined in claim 1 wherein said protective skirt has sufficient material to allow movement of said upper frame relative to said lower frame.

5. The apparatus as defined in claim 1 wherein said brake comprises a pair of opposing serrated surfaces mounted in opposition on said upper and lower frames such selective movement of one of said pair of opposing serrated surfaces between an engaged and disengaged position relative to the other of said pair of serrated surfaces locks and releases said upper and lower frames relative to each other.

6. The apparatus as defined in claim 5 wherein one of said pair of opposing serrated surfaces is formed on a body mounted for selective linear movement and further comprising a camming wedge engaging said body to urge said body vertically.

7. The apparatus as defined in claim 6 wherein said camming wedge is electrically actuated to disengage said pair of opposing surfaces when said driver is providing reciprocal motion.

8. The apparatus as defined in claim 1 wherein said brake is connected to a lever for selective movement between a locking and unlocked position.

9. The apparatus as defined in claim 1 wherein said brake is a caliper mounted to selectively connect said lower frame and said upper frame to arrest movement of said upper frame.

10. The apparatus as defined in claim 9 wherein said caliper is mounted to said lower frame and selectively engages one of said least two transverse upper frame members.

11. The apparatus as defined in claim 1 wherein said brake is a pin and hole brake wherein said upper frame member carries a lock block having an aperture formed therein and said lower frame carries a pin mounted for selective movement into and out of engagement with said aperture formed in said lock block.

12. The apparatus as defined in claim 11 wherein said pin is connected to a linear actuator for movement to said engaged position only when said driver is in an off mode.

13. An apparatus for supporting a mattress of a bed for gentle side to side rocking motion comprising:

a. a lower frame and an upper frame;

b. a plurality of roller carriages supporting said upper frame on said lower frame;

c. a driver connected between said lower frame and said upper frame to reciprocally move said upper frame transversely of said lower frame; and, d. a brake connected between said lower frame and said upper frame to arrest movement of said upper frame relative to said lower frame when said driver is not actuated;

further comprising a protective skirt enclosing said upper and lower frames about a periphery thereof to prevent ingress of objects between said upper and lower frames, wherein said protective skirt is a multilayer construction including an outer stretchable layer and an inner non-stretchable layer having sufficient material to allow movement of said upper frame relative to said lower frame.

14. The apparatus as defined in claim 13 wherein said brake comprises a first member carried on said upper frame and a second member carried on said lower frame, said first and second members configured for selective locking engagement and disengagement.

15. The apparatus as defined in claim 14 wherein said first and second members include cooperatively formed serrated faces with one of said faces selectively movable into and out of engagement with another of said serrated faces to selectively lock said upper and lower frames relative to each other.

16. The apparatus as defined in claim 14 wherein said first member is a lock block and said second member is a caliper positioned to selectively engage said lock block.

17. The apparatus as defined in claim 14 wherein said first member is a lock block having an aperture therein and said second member is a movable pin selectively inserted into said aperture.

* * * * *